United States Patent [19]

Delsing et al.

[11] 4,153,857

[45] May 8, 1979

[54] TELEVISION CATHODE RAY TUBE HAVING GETTER FLASH TOLERANT INTERNAL RESISTIVE ELEMENT

[75] Inventors: Dale Delsing, Evanston; Mark Fogelson, Wilmette, both of Ill.

[73] Assignee: Zenith Radio Corporation, Glenview, Ill.

[21] Appl. No.: 803,907

[22] Filed: Jun. 6, 1977

[51] Int. Cl.[2] ..... H01C 7/00; H01J 29/84; H01J 29/94

[52] U.S. Cl. ..... 313/481; 338/308; 313/479

[58] Field of Search ..... 313/481, 479, 450, 477, 313/397; 338/308

[56] References Cited

U.S. PATENT DOCUMENTS

| | | | |
|---|---|---|---|
| 3,679,471 | 7/1972 | Wyss | 338/308 X |
| 3,979,632 | 9/1976 | Gunning et al. | 313/479 |
| 3,979,633 | 9/1976 | Davis et al. | 313/450 X |

*Primary Examiner*—Robert Segal

*Attorney, Agent, or Firm*—John H. Coult

[57] ABSTRACT

The disclosure depicts in a television cathode ray tube having a getter containing a vaporizable, electrically conductive, gas adsorptive getter material, an improvement comprising an electrically resistive element for arc suppression, an electrically resistive element for arc suppression, internal voltage division, static elimination, RC signal coupling or the like. The resistive element is composed of a high resistivity material compatible with a clean, high-vacuum environment. The element is so widely and deeply cavitated and contorted at and below its nominal surface that the real surface of the element is shadowed and very greatly extended in area relative to the nominal surface of the element. The effect of this is that when the getter is flashed, the coating of conductive getter material deposited on the element is effectively dispersed and fragmented into isolated conductive islands. The result is to render tolerably insignificant the tendency of arc currents to travel over the surface of the element and thereby by-pass the body of the element.

14 Claims, 23 Drawing Figures

Fig. 14A
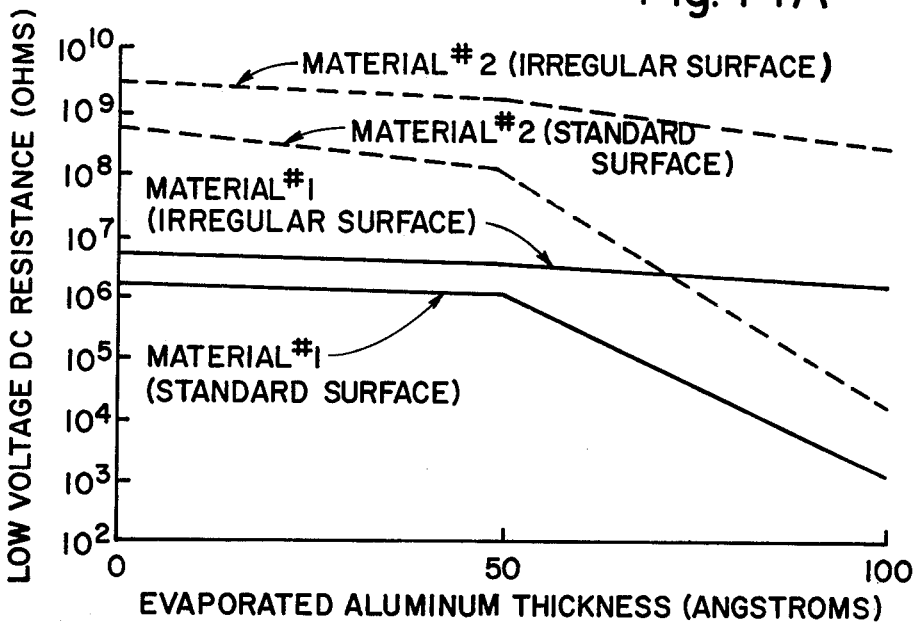
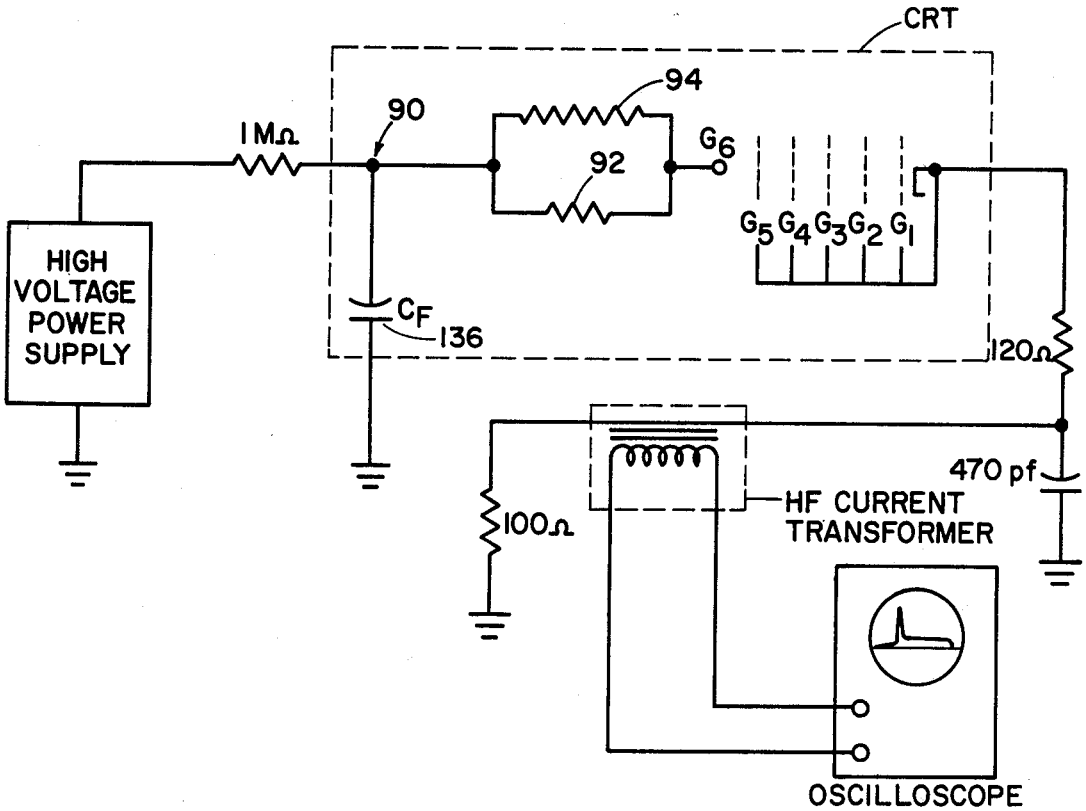
Fig. 18

TELEVISION CATHODE RAY TUBE HAVING GETTER FLASH TOLERANT INTERNAL RESISTIVE ELEMENT

CROSS REFERENCE TO RELATED PATENT APPLICATIONS

This application is related to, but not dependent upon a number of copending applications of common ownership herewith, including: Ser. Nos. 708,817 filed July 26, 1976, Ser. No. 830,270, filed Sept. 2, 1977, Ser. No. 811,494, filed June 30, 1977, and Ser. No. 802,223 filed June 1, 1977 all assigned to the assignee of the present application.

BACKGROUND OF THE INVENTION

This invention relates primarily to resistive structures for television cathode ray tubes for performing such functions as: (1) protecting a tube and its associated circuitry from destructive electrical arcs and arc currents, and from voltages and currents induced by such arcs; (2) eliminating static charge accumulations on insulating surfaces inside a tube; (3) providing a mechanism within a tube for voltage division; (4) providing internal resistive-capacitive signal coupling networks.

The envelope of a television cathode ray tube comprises a glass funnel and a mating faceplate. The funnel has a neck within which is located an electron gun. The faceplate of the tube has a fluorescent screen on which is impressed a very high DC voltage — typically in the range of 20–30 kilovolts or more.

Conductive coatings on the inside and outside of the funnel serve as a capacitor which filters the high voltage supplied to the screen. The inner conductive coating is at screen potential and also serves to transmit the screen voltage to the neck of the tube where it is applied to a high voltage anode electrode at the forward end of the electron gun.

The electron gun has for each electron beam a cathode and a series of closely spaced electrodes which shape, accelerate and focus the electron beam(s) generated in the gun. To accomplish these functions, the various electrodes require widely different electrical potentials. The large voltage difference established between certain high voltage and low voltage electrodes in the gun creates a susceptibility to arcing between the electrodes, e.g. should there exist particulate foreign matter in the inter-electrode space, a burr on an electrode, a misaligned or improperly spaced electrode, or the like. When the conditions for arcing are right, the high voltage filter capacitor, with its immense stored electrical energy, will in a few microseconds dump its stored charge, inducing transient currents in the associated receiver circuitry.

Because the instantaneous peak arc currents can reach hundreds of amperes in magnitude, great destruction can be wrought by such arcs. External circuitry can be damaged; internal gun parts can be eroded to the point of inoperability or severely reduced in their effectiveness. High arc currents are capable of sputtering electrode materials onto adjacent surfaces, resulting in the formation of electrical leakage paths. Further, arcing in a tube during its normal operation can result in a loud audible report which may be quite disturbing to a viewer.

In recent years, the design evolution of color picture tubes has taken a direction tending to exacerbate the arcing problem. The desire for greater picture brightness has driven the screen voltage inexorably upward toward and even beyond 30 kilovolts. A trend toward wider beam deflection angles and a desire to minimize power consumption have dictated the use of tubes with smaller neck diameters. A small neck diameter implies a more closely confined environment for the electron gun, with the attendant increased probability of arcing between components of the electron gun assembly or between the gun assembly and the containing tube envelope.

In order to reduce tube arcing, it is routine today to design color tubes and electron gun assemblies with every effort to maximize intercomponent spacing, to minimize points of field concentration, and otherwise to configure the tube and gun structures to minimize the tendency of a tube to arc. After a tube receives its electron gun and the envelope is sealed, it is commonplace to "spot-knock" (high voltage condition) the gun. "Spot-knocking" is an operation wherein a pattern of fluctuating and constant voltages of high magnitude are applied to the tube to "knock" (remove) loose particles which may have lodged between gun electrodes, burrs on electrode parts, and other agents which might lead to arcing of the tube during its normal operation. Typically peak voltages during spot knocking are much higher than the screen operating voltage. Spark gaps, diodes, filters, gas discharge lamps, and other protective devices are commonly provided in the associated receiver (at significant cost) to protect receiver circuitry from damage by arc induced currents and voltages.

Television picture tube manufacturers have long attempted to develop an internal resistive element which would be coupled in series with the high voltage filter capacitor and the electron gun to suppress the magnitude of arc currents and thereby to overcome the potentially destructive effects of arcing in the tube during tube operation.

The requirements for such an internal resistance element are, however, extremely severe. Following are some of the requirements, not necessarily in their order of importance, of an internal resistive element for protecting a television picture tube against arcing.

Requirement 1. The resistive element must be compatible with the clean high vacuum environment inside a cathode ray tube. The element cannot emit gas which would significantly decrease the tube's vacuum level or impair the performance of the cathode in the electron gun assembly. The element cannot flake, erode, ablate, or otherwise generate particles which might block openings in a color selection electrode or lodge in a gap between gun electrodes.

Requirement 2. The resistive element must be compatible with the tube's fabrication processes. Perhaps the most severe of the fabrication processes are the high temperature cycles which a color tube is subjected to when the faceplate is sealed to the funnel and during exhausting (and sealing) of the tube. Temperatures may reach 430° C. or higher during these high temperature operations.

Requirement 3. The resistive element must have an effective impedance which is relatively stable at a selected point in an appropriate impedance range — for example a few kilohms to tens of megohms. If the dynamic impedance of the element is too low, inadequate protection against arc currents will be provided. If the DC resistance of the element is too high (e.g. $10^{12}$ ohms), the material will act as an insulator and collect stray charges which may alter the electron beam paths or initiate arcing. Further, if the DC resistance of the element is too high, the voltage drop across the element as a result of leakage current flowing through it will result in an intolerable drop in the voltage applied to the anode electrode of the gun. A resistive element may have an appropriate DC resistance but, when situated in a finished tube, have a stray capacitance which is so high as to establish a low dynamic impedance path for an arc transient.

Whereas it has long been known that an internal arc suppression resistor must have an appropriate value of DC resistance, it is believed that the distributed (stray) capacitance problem has not been fully appreciated.

Requirement 4. The resistive element cannot be physically obtrusive to the electron beams. As noted, there is a very limited amount of space available in the neck of a television cathode ray tube, particularly a tube of the small neck type, and particularly in the region near the front of the electron gun. Because of this space limitation, it has proven to be difficult to design a non-obtrusive discrete internal resistive element.

Requirement 5. The resistive element must be capable of being satisfactorily electrically terminated at each end. If the resistive element is a neck coating, it has been found that even modest arc currents are apt to cause localized heating of the glass underneath the contact point(s) with the result that the glass may chip or become predisposed toward eventual failure. It is difficult to maintain contact integrity after a number of arcs have occurred.

Requirement 6. The television industry being highly competitive, the resistive element and its cost of installation must be low enough to be commercially viable.

Requirement 7. The requirement last to be described is not last in importance — it is perhaps the reason that no television tube having within it an arc suppressing resistive element has been marketed commercially. This seventh requirement is that the resistive element not be susceptible to being by-passed or nullified due to conductive deposits on the surface thereof.

Specifically, all television cathode ray tubes today utilize a "flashed" (vaporized) "getter" material which "gets" (adsorbs) residual gases in the tube after the tube has been pumped down as far as is practicable and sealed off. The gas-adsorptive getter material most commonly employed is a barium compound. Barium is highly electrically conductive, however. When the getter is flashed, a conductive barium coating is deposited on substantially all exposed areas within the tube. In order to "get" the greatest quantity of residual gas, the getter must be flashed over a wide area inside the tube; inevitably, getter material is deposited on the resistive element.

It is clear that any resistive element used for arc suppression, voltage division or the like, will be effectively by-passed or nullified if a shunt path around the resistive element is created by conductive getter material. Attempts to reduce the area of getter flash by shielding or by use of directional evaporation of getters reduce the pumping speed and effectiveness of the getter. As noted, this seventh requirement is perhaps the thorniest of all and has stalled development of commercially practicable internal arc suppression resistive systems.

PRIOR ART

One approach disclosed in the prior art is to deposit an electrically resistive coating on the inner surface of the envelope of the lower end of the tube funnel or in the neck. The coating makes contact at one end with the conductive inner coating on the funnel and at the other end with the electron gun assembly. Perhaps the first patent to suggest such an approach to arc suppression is U.S. Pat. No. 3,829,292-Krause. See also U.S. Pat. Nos. 3,555,617, 3,961,221, and 3,979,633 and Technical Note 039, published on March 1, 1977 by N. J. Phillips Gloeilampenfabrieken.

It has been found to be quite difficult to achieve coatings which have the proper resistance value and which are not prone to contact burn-off or flaking as, for example, when the electron gun assembly is inserted into the neck of the tube and the sled on which the attached getter rides scratches over the coating. The problem of providing a dynamic impedance which is sufficiently high is severe in coating-type arc suppression resistors. No prior art resistive coating system is known which is capable of withstanding a frontal getter flash without having its effective resistance value drastically reduced. We are familiar with experimental color television picture tubes which have been made with an arc suppression funnel coating composed of a resistive frit material comprising a devitrifying glass cement incorporating a metallic oxide or modifier in a proportion appropriate to give it the desired resistivity. Such tubes have demonstrated a capability of adequate arc suppression. However, such a resistive coating has been found to suffer a drastic and unacceptable loss of its arc suppression capability when the coating is subjected to a conventional getter flash.

U.S. Pat. No. 3,979,633 discloses a color cathode ray tube having an arc suppressive resistive coating between the gun and the inner conductor on the funnel. FIG. 1 is in part a reproduction of the first figure in prior art U.S. Pat. No. 3,979,633. The 3,979,633 patent discloses a color cathode ray tube 11 having a neck 13, a funnel 15, and a face panel 17.

The funnel 15 has an outer conductive coating 29 and an inner conductive coating 33. The inner conductive coating 33 is accessed through a high voltage anode button 35 passing through the funnel. The outer and inner conductive coatings form a filter capacitor for smoothing high voltage supplied to the tube from a high voltage power supply 36. Circuitry for driving the tube's electron gun is shown schematically at 38. Power supply 36 and gun drive circuitry 38 have been added to FIG. 1 of U.S. Pat. No. 3,979,633 for clarity of illustration.

The FIG. 1 prior art tube is disclosed as including an arc suppression system comprising a "high resistive coating" 39 on the interior surface of the funnel 15 in the region at which the neck 13 joins the funnel. The resistive coating 39 is electrically joined at its forward end with the inner conductive coating 33. At its rearward end, it is contacted by a snubber spring 49 on an anode electrode 45 constituting part of the electron gun assembly 27.

The resistive coating 39 is said to be comprised of a glass frit-based composition having, for example, suitable metallic oxide inclusions. The resistive coating is said to have a resistivity of, for example, $10^5$ to $10^7$ ohms per square. The arc suppression system described is said to provide a resistive path between the conductive anode button 35 and the anode electrode 45 of the gun assembly having a DC resistance value of 0.5–10 megohms. It is said that in tubes employing the described arc suppression system peak arc currents seldom exceed 0.5 to 1.0 amperes.

The 3,979,633 patent disclosure asserts that prior art systems which use an arc suppression coating, such as disclosed in U.S. Pat. No. 2,829,292, are deficient in that "it was found that getter and other sublimation deposits within the tube tended to bridge the resistance coating, thereby decreasing the intended benefit" (column 2, line 7). The 3,979,633 patent, in order to provide arc suppression while preventing the shorting of the high resistive coating 39 by deposited getter material, provides a modification of the getter "having a discretely shaped diffusion director integral therewith and oriented on a component structure within the tube to discretely direct the effusion of getter material in a manner to prevent the formation of a conductive path across the high resistive coating 39" (column 4, lines 45–50).

Two different getters are shown in FIG. 1 — one at 51 and the other at 63. Each of the getters is structured and oriented with the intent that when it is flashed, the getter material does not fall upon and short circuit the high resistive coating 39. FIGS. 4–5 and 6–7 of the 3,979,633 patent (not reproduced here) disclose two other similarly intended getter embodiments.

The disclosed 3,979,633 patent approach of averting the getter flash deposition pattern away from the high resistive coating 39 in order to prevent shorting of the coating, is believed to be an unsatisfactory solution. Getter 63 is located on the shadow mask and is not removable from the tube when the neck is taken off to salvage and reconstitute the tube. Attachment of the getter 63 to the mask is apt to alter the mechanical or thermal characteristics of the mask. Regarding all getter embodiments disclosed in the 3,979,633 patent — it has been found that restriction of the getter diffusion pattern results in impaired efficiency of the getter to adsorb gas within the tube. Also, in spite of the getter modifications and relocations it is believed that attempts to keep getter deposits off the high resistive coating 39 will not be successful, particularly if an effective getter of the gas-doped type is used. Regarding getters 51 (FIG. 1) and getter 85 (FIGS. 6–7 — not reproduced) — it is known to be difficult to mount a ring getter about the beam egress from the gun which does not interfere with the electron beams. Also, ring getters within the neck can't be large enough to hold sufficient amounts of getter material.

The second basic approach to providing an internal arc suppressing resistive element is to provide a discrete resistor between the inner conductive funnel coating and the forward end of the electron gun. See, for example, U.S. Pat. Nos. 3,882,348; 3,909,655; and 3,295,008, and British patent No. 1,448,223. None of these systems are believed to be capable of meeting the aforesaid requirements. The requirement that the resistor not interfere with the electron beams is particularly severe with regard to discrete resistor systems.

Providing a discrete resistor with the right dynamic and DC impedance has also proven to be difficult. Further, the discrete resistor has been found to be, as a practical matter, also prone to nullification by a getter flash.

The referent copending application Ser. No. 708,817 describes and claims an arc suppression resistor with a provision for shadowing the exposed surface of the resistor from getter flash deposits. The approach described and claimed in the referent application represents an improvement in the direction of achieving immunity from resistance nullification by getter deposits. However, in its application to small neck tubes it has been found exceedingly difficult to achieve a resistor design which does not obstruct the electron beam(s).

Yet another approach to achieving arc suppression, believed to be ineffectual, is expounded by U.S. Pat. No. 3,267,321.

An internal coating used as a resistive or RC network or voltage divider is plagued with similar constraints. Regarding arc suppression coating compositions, see U.S. Pat. No. 4,018,717.

OTHER PRIOR ART

U.S. Pat. No. 3,758,802

OBJECTS OF THE INVENTION

It is an object of the present invention to provide for television cathode ray tubes an improved electrically resistive element for arc suppression, internal voltage division, static elimination, RC signal coupling or the like, which element satisfies all requirements for such a system.

It is yet another object of the present invention to provide such a resistive element which is extremely effective in overcoming the problem of resistance nullification by conductive getter flash deposits.

BRIEF DESCRIPTION OF THE DRAWINGS

The features of the present invention which are believed to be novel are set forth with particularity in the appended claims. The invention, together with further objects and advantages thereof, may best be understood by reference to the following description taken in conjunction with the accompanying drawings, in the several figures of which like reference numerals identify like elements, and in which:

FIG. 14A is a graph comprising the immunity to shorting by conductive deposits of resistive coatings with and without an irregularized surface topography according to this invention.

FIG. 18 is a schematic diagram of test apparatus used to measure the dynamic impedance which a system embodying the present invention presents to an arc current.

DESCRIPTION OF THE PREFERRED EMBODIMENTS

Figures 2, 2A, 2B:
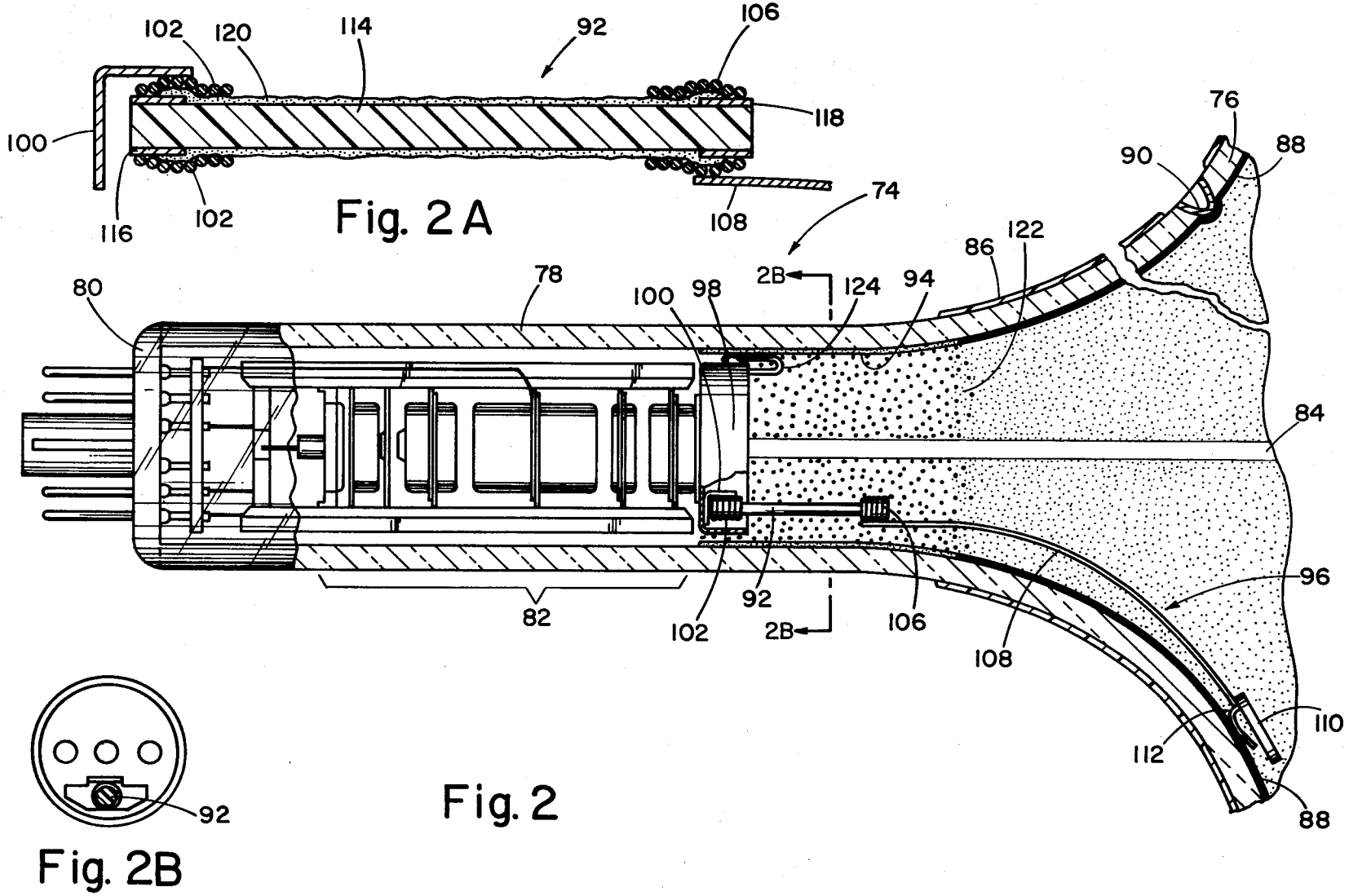
FIG. 2 is a sectional side view of a portion of a color cathode ray tube embodying the teachings of the present invention.
FIG. 2A is an enlarged view of a discrete arc suppression resistor shown in FIG. 2.
FIG. 2B is an enlarged front elevational view of an electron gun comprising part of the FIG. 2 tube.

A preferred implementation of the principles of the present invention will now be described. FIG. 2 is a sectioned side view of a portion of a color cathode ray tube embodying the present invention. Before discussing the present invention, however, certain tube components which comprise the environment for the present invention will be described.

The FIG. 2 implementation of the present invention is shown as including a portion of a glass funnel 76 which blends into a neck 78. The neck 78 is terminated by a base 80 supporting a number of pins through which electrical communication is made between the television chassis and the interior of the tube 74.

In the neck of the tube is disposed an electron gun assembly 82 which generates one or more electron beams. In the illustrated embodiment the tube is a color cathode ray tube; the gun assembly 82 generates three coplanar beams which are shown edge-on at 84. The tube includes an outer conductive coating 86 which is maintained at ground potential and an inner conductive coating 88 which receives a high voltage from an exterior source (not shown) through an anode button 90. The inner and outer conductive coatings 86, 88 constitute a high voltage filter capacitor and may be of conventional composition.

The present invention concerns the provision of an improved resistive element for use in a television cathode ray tube for arc suppression, internal voltage division, static elimination, RC signal coupling or the like. In the illustrated FIG. 2 embodiment, the resistive element improvement is implemented in two ways — in a discrete arc suppression resistor 92 and in an anti-static coating 94. Together the arc suppression resistor 92 and the anti-static coating 94 constitute a parallel system of resistors which collectively provide the function of arc suppression and static elimination. The concept of a system of parallel arc suppression and static elimination resistive elements does not constitute a part of this invention, per se, but is described in detail and claimed fully in referent copending application Ser. No. 802,223. The system of parallel elements will be described more fully herein after a description of the arc suppression resistor 92 and the anti-static coating 94.

The discrete arc suppression resistor 92 supports a getter assembly 96. The arc suppression resistor 92 is mounted on an anode electrode 98 constituting part of the last element of the main focus lens of the gun assembly 82. See also FIGS. 2A and 2B. The arc suppression resistor 92 is supported by a bracket 100 welded to a coil spring connector 102. The coil spring connector 102 tightly grips the end of the arc suppression resistor 92, here shown in the form of a cylindrical rod. The connector 102 makes a very sound mechanical and electrical engagement with the resistor 92. At the opposite end of the resistor 92 is a second coil spring connector 106 which is similar to the connector 102. The coil spring connectors per se, do not constitute an aspect of the present invention, but are described and claimed in the referent application Ser. No. 830,270.

A leaf spring getter support 108 is welded to the coil spring connector 106 and at its distal end carries a getter pan 110. The pan 110 is supported on runners 112 in firm physical and electrical contact with the inner conductive coating 88. The pan may carry a quantity of conventional getter material — for example gas-doped barium compound.

Should conditions exist for an arc to occur in the gun, for example, as a result of a foreign particle lodging in a narrow inter-electrode space in the gun assembly 82, an arc current will propagate through the getter runner 112, support 108, arc suppression resistor 92, through the gun assembly 82 and associated gun drive circuitry to a ground within the receiver. As a result of the introduction of the arc suppression resistor 92 between the inner conductive coating 88 and the gun assembly 82, the magnitude of the arc current will be greatly suppressed, for example by an order of 100 to 1 or more. A 100 ampere arc current is thus suppressed to a relatively harmless 1 amp or less. This arc suppression is found to be effective even at voltages considerably higher than the maximum rated operating voltages for commercial color CRTs. The particular structure of the resistor 92 and its terminations do not constitute an aspect of the present invention, per se, but rather is described and claimed in the referent application Ser. No. 811,494. The parallel combination of an anti-static neck coating with a discrete arc suppression resistor on the gun is, per se, described and claimed in the referent application Ser. No. 802,223, filed.

Although a variety of other resistor configurations are contemplated, in the illustrated preferred embodiment the resistor 92 is shown as comprising a cylindrical rod 114 on the opposed ends of which are deposited conductive termination coatings 116, 118 — nickel, silver, iridium, or gold, for example, which assure sound electrical contact with a high resistivity coating 120 constructed in accordance with the present invention (to be described in detail hereinafter). The high resistivity coating 120 overlaps the metal termination coatings 116, 118, in order to assure the integrity of the electrical connection therebetween under high vacuum arcing conditions.

Briefly, the coil spring connectors 102, 106 serve to provide a sound mechanical and electrical connection with the ends of the resistor 92. The coil spring connectors may be formed of Inconel, a metal which has a spring characteristic and is compatible with the clean, high vacuum environment within a cathode ray tube. The connectors 102, 106 have a number of advantages over other types of connectors which were tried. First, because they are expanded coil springs, they very securely grasp an inserted end of the rod. Due to their compliant nature they follow the step at the end of the high resistivity coating 120 and make good electrical contact with not only the metal termination coatings 116, 118, but also with the end of the high resistivity coating 120. After the connectors 102, 106 have been permitted to constrict upon the ends of the rod 114, they are locked in place by welding on the bracket 100 and getter support 108. The connectors 102, 106 have the advantages over other terminations which might be employed of low cost, extremely firm mechanical engagement, highly sound and reliable electrical engagement and mechanical strength for supporting the getter pan 110 and support 108.

The arc suppression resistor 92 has an optimum length. If the resistor is too short, the resistances of the resistor and its protection against arcing is reduced. If the resistor is excessively long, it will intrude into the electron beam deflection space. It has been found that the length of the resistor, in a 100° deflection, narrow-neck, in-line gun environment as shown, should be between 1.0 and 1.75 inches, preferably about 1.5 inches. The dynamic impedance of the resistor should fall somewhere in the range of a few kilohms to a few tens of megohms. At the low end of this range the arc protection provided is marginal. At the high end of the range the IR drop through the resistor 92 due to leakage current through the resistor begins to adversely reduce the voltage on the anode electrode of the gun assembly 82. It has been found that the preferred dynamic impedance for the arc suppression resistor 92 is in the range of about 0.1 to 5 megohms.

The arc suppression resistor 92 has, in accordance with the present invention, a surface, the topography of which is such that flashing of getter material on the resistor is not effective to pre-dispose the surface thereof to arc propagation or to materially reduce the impedance thereof. In the illustrated embodiment the resistor is shown as comprising the ceramic rod 114 upon which is disposed the high-resistivity coating 120. The coating 120 has a novel topographical structure according to the present invention. The surface of the arc suppression resistor 92 has a topography which is such that when the getter is flashed, any conductive getter material deposited on the resistor is fragmented. As will be explained in more detail, the real surface of the resistor is so widely and deeply cavitated and contorted at and below the nominal surface of the resistor that it is shadowed and many times increased in area relative to the said nominal surface. The result is that the impedance of the resistor is not materially reduced as a result of a normal getter flash. This is due to the fact that the getter material deposited on the rear surface of the resistor is effectively dispersed and fragmented into isolated conductive islands spread over a very greatly magnified real surface of the resistor, the effect of which is that the impedance of the resistor is not materially reduced and any increase in the tendency of arcs to travel over the surface of the resistor and thereby to by-pass the body of the resistor, is tolerably insignificant.

Figure 3:
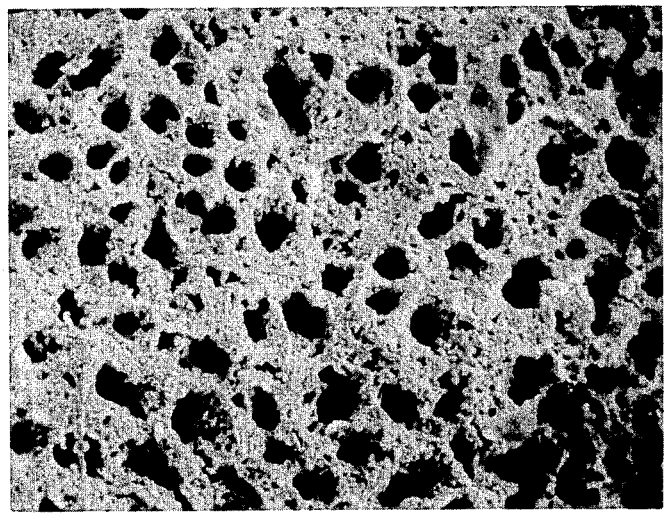
FIGS. 3–7 are scanning electron beam photomicrographs of resistive elements structured according to the present invention.
Figure 4:
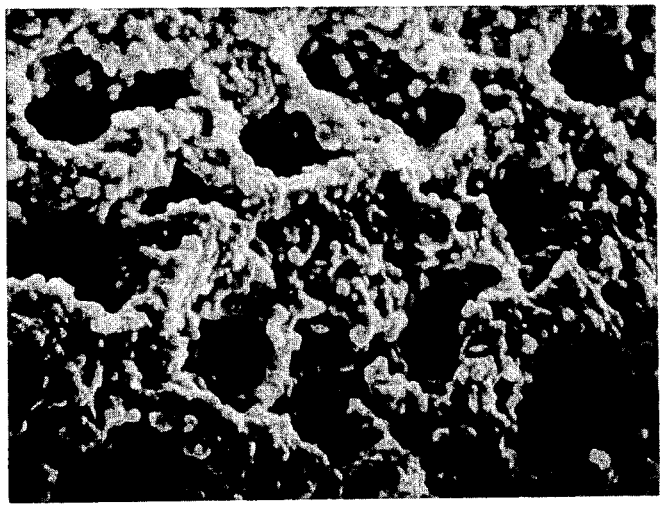

FIGS. 3 and 4 are scanning electron photomicrographs of the surface of the arc suppression resistor 92. FIG. 3 is a view of the surface at an angle of 45° to a normal to the surface, magnified 800 times. FIG. 4 is a view of the same surface, again at an angle of 45° to the normal, but at a magnification of 3,000. Although a variety of materials may be employed in a preferred embodiment, the resistive material utilized for the arc suppression resistor 92 is a coating of resistive frit material containing a metallic modifier such as tin oxide in an amount appropriate to give the frit the desired resistivity. The thickness of the coating may, e.g. be approximately 0.2–5.0 mils. A method by which the surface may be caused to have the porated, heavily cavitated and contorted surface of greatly extended real surface area will be described later herein.

The anti-static coating 94 will now be discussed. The anti-static coating makes very important contributions to the overall efficacy of the arc suppression system. First, as will be explained in more detail hereinafter, it provides a high resistance, getter-flash-protective barrier preventing by-passing by an arc around the arc-suppression resistor 92. It has been found that in many prior art approaches which utilize discrete arc suppression resistors, conductive deposits on neck glass in the vicinity of a discrete resistor will form conduction paths by which an arc may by-pass the discrete arc suppression resistor and reach the gun to do damage to the gun and to the associated receiver circuitry. Low resistance colloidal graphite coatings on the neck, if used to overcome this problem, will cause electrical breakdown (arcing or by-pass of the resistor). Secondly, the anti-static coating drains off stray electron charge which might otherwise collect on the interior of the tube neck and act to divert the electron beams.

Thirdly, capacitive coupling of an arc through the yoke and around the arc suppression resistor is minimized due to the high impedance of the coating and the discrete arc suppression resistor 92.

In more detail, the anti-static coating 94 overlaps and makes electrical contact with the inner conductive coating 88 along an overlap 122. At the gun end of the anti-static coating 94, the coating is electrically and physically contacted by a plurality of snubber springs 124 carried by the anode electrode 98. A uniform anode potential is provided in the area of the anti-static coating 94 by means of the high voltage applied to the inner conductor 88.

Figure 5:
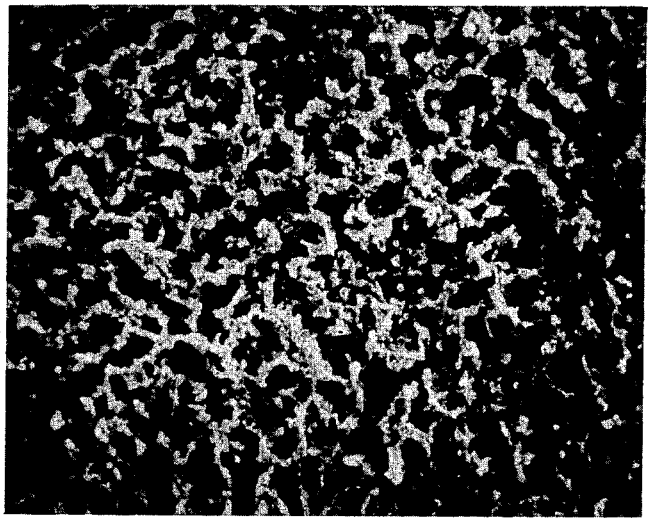
Figure 6:
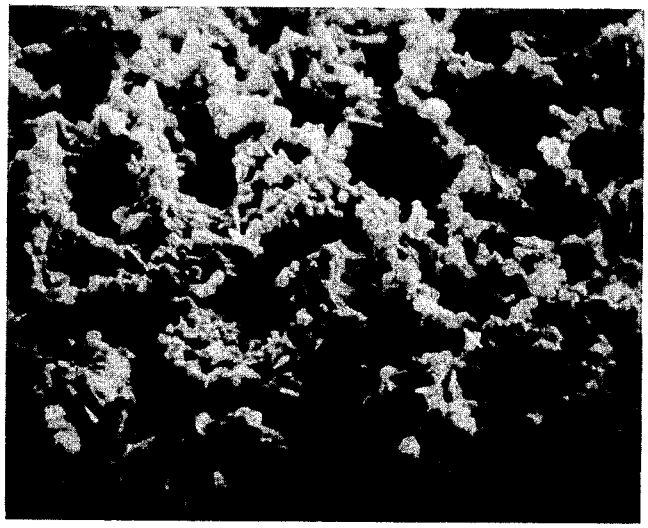
Figure 7:
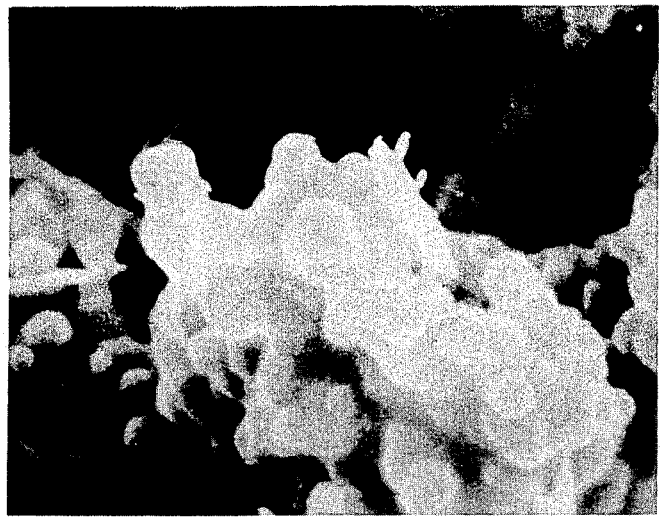

FIGS. 5 and 6 are scanning electron micrographs of the anti-static coating 94. This coating is preferably also composed of a resistive frit material. If of the same composition as afore-described, it is deposited in a lesser thickness than on the resistor 92 to produce a higher resistivity coating. FIGS. 5 and 6 depict a coating of the same composition as the coating on resistor 92, but somewhat thinner — for example a few ten-thousandths of an inch thick. The thin anti-static coating has a somewhat different appearance from that of the coating on the arc suppression resistor 92. The anti-static coating appears more leafy than porated. It can be seen that in both cases the real surface of the resistive element coating is so contorted and cavitated that the normal getter material deposits (e.g. 50–500 angstroms in thickness) are effectively fragmented by the surface of the coating, the getter material coating being effectively broken up and distributed over such a large real surface area that the impedance of the element is not materially reduced and the formation of conductive paths across the element which might encourage the propagation of an arc is negligible. FIG. 5 is a scanning electron photomicrograph at 1,000 times magnification, taken at 0° (normal) to the surface. The FIG. 6 photomicrograph was taken at 3,000X at an angle of 45°. FIG. 7 is a view of the same anti-static coating, but at a magnification 20,000 at an angle of 45° to the normal to the surface.

Figure 8:
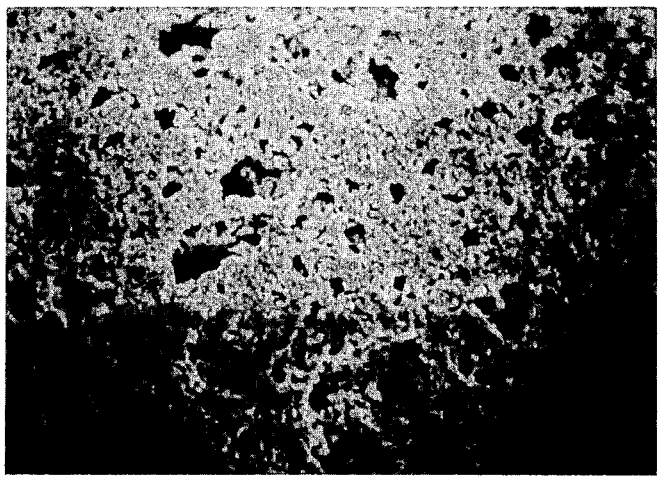
FIGS. 8 and 9 are scanning electron beam photomicrographs of the surface of a prior art resistive element.
Figure 9:
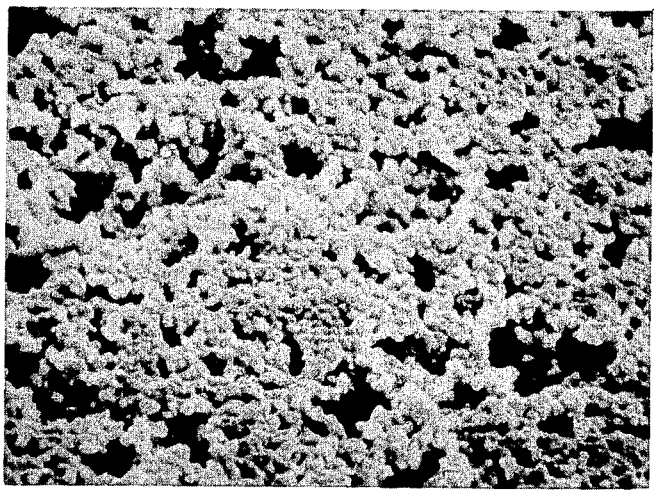

By contrast to the extremely irregular topography of the real surfaces of the coatings on the arc suppression resistor 92 and the anti-static coatings 94, the same resistive frit material deposited on flat glass, but without the surface irregularization according to this invention appears as shown in FIGS. 8 and 9. FIG. 8 is a view at 0°, 1000X magnification of a 1–2 mil thick coating of a resistive frit material manufactured by Corning Glass Works of Corning, New York and identified by that manufacturer as Glass 8464. FIG. 9 is a view of the same surface at 45°, 3,000X. Note that although the reference specimen does show some modest porosity, the photomicrographs clearly reveal why this material with its prior art topographical structure is less capable of functioning as a getter-flash-protected resistive element. It can be seen that there is continuity in the real surface of the specimen which, upon deposition of getter material, will result in the formation of a substantially continuous path across the resistive element which materially reduces the impedance of the element and along which an arc is encouraged to travel.

Figures 10, 10A:
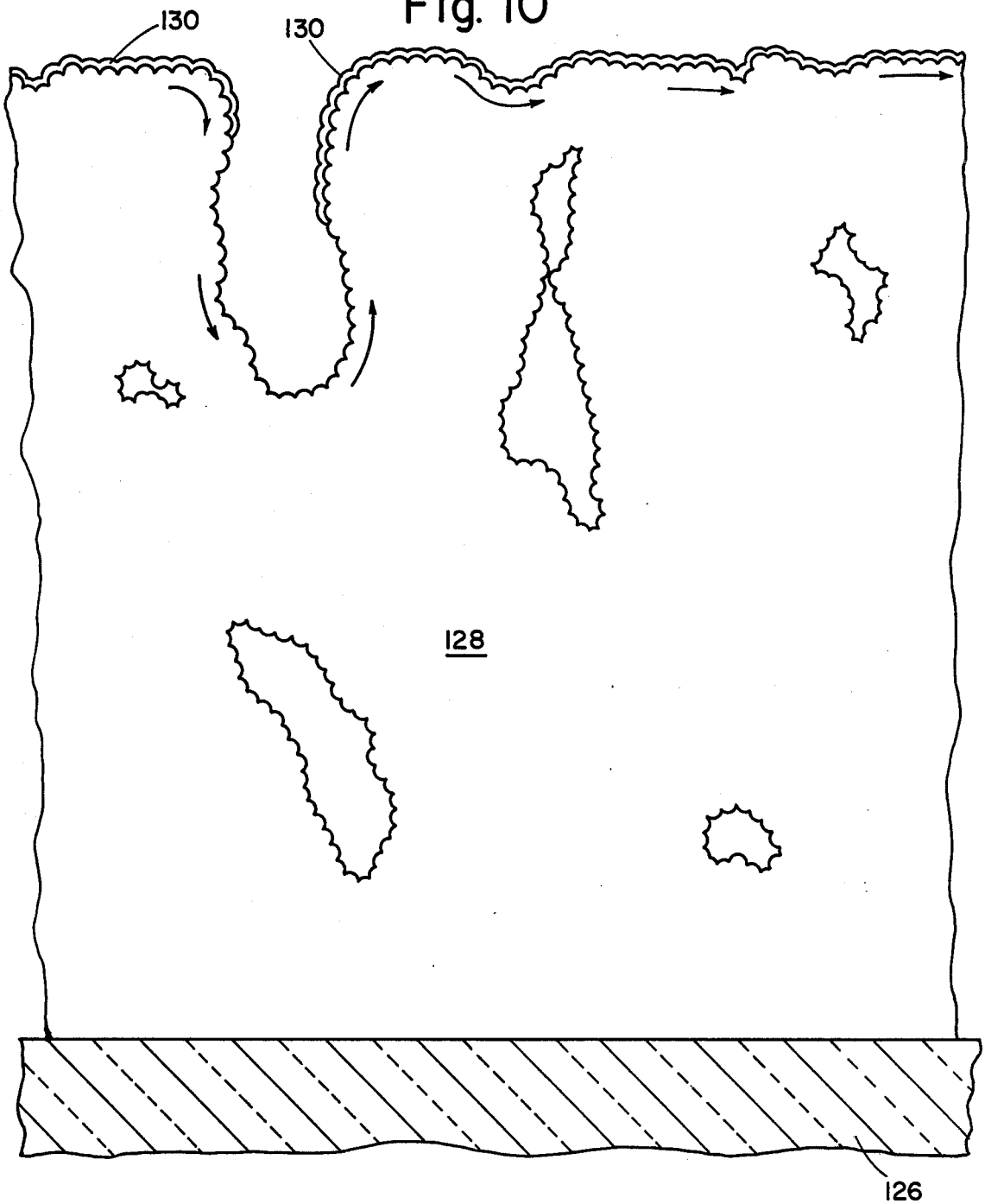
FIGS. 10 and 10A are physical and electrical schematic illustrations of a prior art resistive coating after it has received conductive getter flash deposits.

Perhaps the reason why a resistive element constructed according to this invention is so getter flash resistant compared with a prior art non-irregularized resistive element fabricated from the same resistive frit material can be understood by reference to FIGS. 10, 10A, 11 and 11A. FIG. 10 schematically illustrates a prior art resistor comprising a substrate 126 on which is disposed a standard, non-irregularized (prior art) coating 128 of resistive frit material. Getter flash deposits, as they might appear after flashing of a standard gun-mounted antenna-type gas-doped barium getter in a tube containing the prior art resistor are shown at 130. The arrows indicate the path which arc currents may move along such a surface. It can be seen that since the getter flash results in a substantially continuous coating of conductive material over the surface of the resistor, arc currents will be encouraged to traverse the real surface of the resistor and by-pass the resistor body. Stated another way, the surface resistivity of the coating is significantly lower than the bulk resistivity of the coating 128. Short uncoated areas in the conductive coating will be traversed by passage of the arc currents through the resistor body. Or, the short areas may be jumped by the arc current. How does this arc jumping phenomenon happen? It is believed to happen as follows. When an inter-electrode gap in the gun is bridged, a high voltage deriving from the charged filter capacitor appears across the arc suppression resistor. Since most of the resistor real surface is coated with conductive material, this voltage appears across the small uncoated areas in the getter coating. As a result of electron and gas emission from the coating at the edges of the uncoated areas, an incipient arc occurs across one or more of these small uncoated areas in the conductive getter coating. This rapidly leads to a breakdown across the entire resistor. Without a significant damping resistance in the arc current path, arc currents may reach hundreds of amperes in intensity. Breakdown, as described, typically manifests itself as a luminous glow across the resistor.

FIG. 10A is an electrical schematic diagram of the FIG. 10 structure. Note that arc currents see a significant resistance only where the currents must depart from the conductive getter deposits and pass through the body of the resistive coating 128 (assuming the uncoated areas aren't jumped, as described above).

Figure 11:
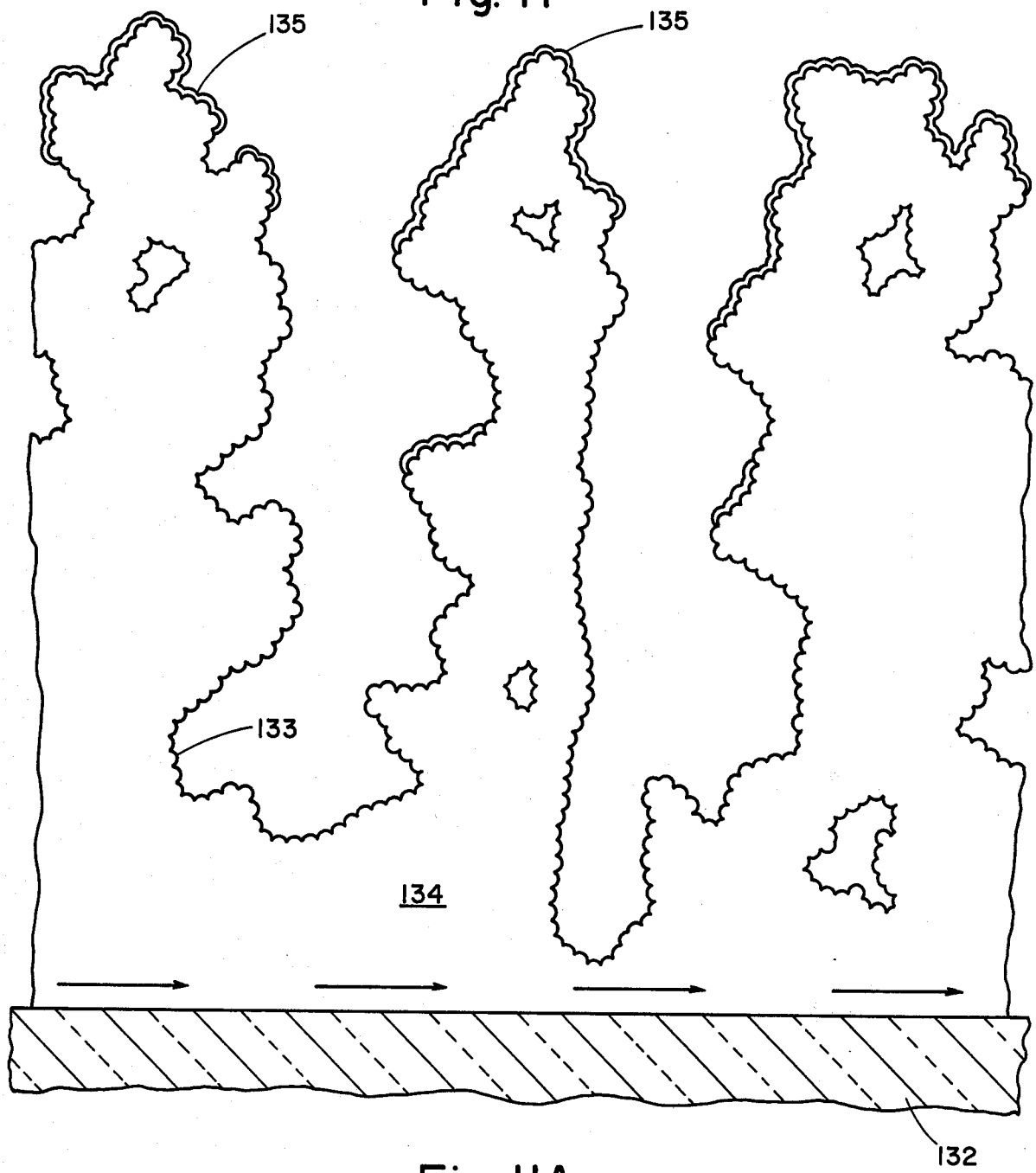
FIGS. 11 and 11A are corresponding physical and electrical schematic illustrations of a resistive coating according to the present invention. The figures illustrate the surface conduction characteristic of the prior art embodiment and the improved bulk mode conduction characteristic of the resistive element constructed according to the present invention.
Figure 11A:
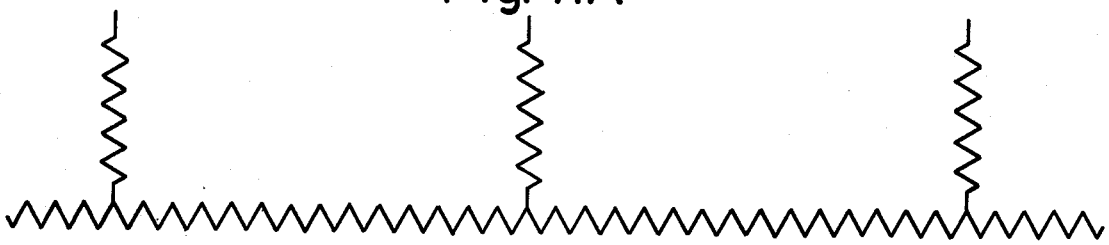

FIG. 11 is a corresponding view of a substrate 132 upon which is deposited a coating 134 of the same material but having a contoured and heavily cavitated topography according to the present invention. Again, as in FIG. 10, getter-flash deposits 135 are shown as they might appear on the real surface 133 of the coating 134. The arrows reveal the path of an arc current through the body of the arc suppression resistor structure shown in FIG. 11 (the body of coating 134). Because the real surface 133 of the coating, that is the actual tangible surface of the coating which extends down into the surface cavities and pores of the coating, is so greatly extended by comparison with the nominal surface of the coating, the getter coating is fragmented and the fragments are effectively widely scattered on the real surface of the resistive coating. As used herein, the term "nominal surface area" is intended to mean the surface of the coating or resistor as defined by the gross dimensions thereof, or as would be measured by a micrometer or other gross dimension meter.

In this second example, because the openings between the getter coating islands scattered on the exposed real surface of the resistor are relatively large, the aforesaid incipient arcs are not established. Further, even if the conditions were right for an incipient arc to be established, the large series resistance in the current path would act to quench the incipient arc before it can get started. This condition may be likened to a cathode which, though potentially a good electron emitter, has in series with it a resistance whose value is so great as to suppress emission from the cathode.

It can be seen that because the getter deposits 135 are so dispersed and fragmented, with no continuous path for an arc current to follow along the real surface of the resistor, and no breakdown across the resistor, the path of least resistance for the arc current is through the body of the resistive coating. Stated another way, the bulk mode resistivity of the coating 134 is significantly less than the surface resistivity thereof. Thus, arc currents are suppressed due to the direct insertion in the series path of the currents of a very large resistor.

A method of making a relatively getter-flash-tolerant resistive element according to this invention is as follows. The resistive frit coating may have the following composition, prepared in the form of a suspension: 7.2 grams of ball-milled resistive frit supplied by Corning Glass Works of Corning, New York as Glass 8464; 1.8 grams of vehicle F1300A supplied by the Pierce and Stevens Company of Buffalo, New York, or equivalent; 1.8 grams of camphor; and 1.2 grams of ethyl propionate or equivalent. The substrate for the coating 120 on the discrete arc suppression resistor 92 may be composed of alumina, steatite, glass or other equivalent material. The suspension may be applied by brushing, spraying, dipping or other suitable process. The thickness of the coating will, to a degree, affect the resistance thereof - the thinner the coating, the greater its resistance -- as will be explained in more detail hereinafter. By way of example, the coating on the rod 114 for the discrete arc suppression resistor 92 may be about 2 mils thick. As noted the anti-static coating may be a few ten-thousandths of an inch thick.

The surface irregularizing agent in the formulation being discussed is camphor. Crystallization of the camphor from the suspension causes the surface of the coating to have the extremely irregular surface topography which characterizes the present invention.

Figure 12:
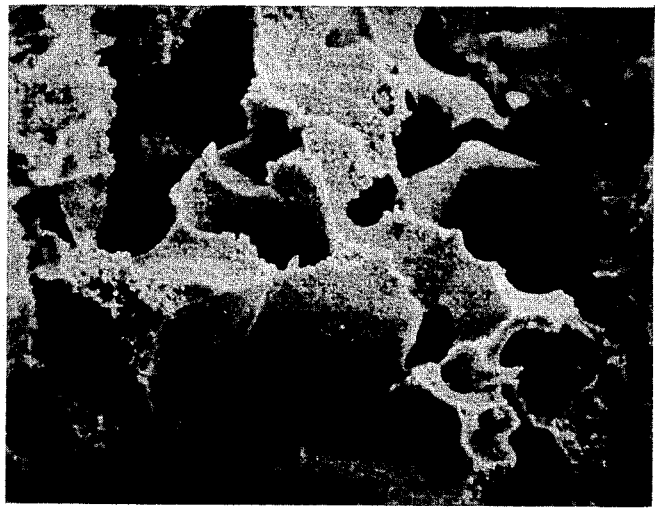
FIG. 12 is a photomicrograph of a resistive coating according to the present invention, as the coating appears during an intermediate stage of fabrication.

Upon volatilization of the solvents from the suspension, and after camphor crystallization has performed the function of surface irregularization, the in-process coating may appear as shown in the FIG. 12 scanning electron photo-micrograph. The next step in the method of coating fabrication under description is to bake the coating in air, for example for 20 minutes at about 430° C. This has the effect of devitrifying the frit to form an extremely hard and abrasion-resistant coating. The final step in the resistive coating processing is a vacuum bake in the CRT during the CRT exhaust cycle at which time the resistance achieves a useful value which may be several orders of magnitude less than the resistance after air bake. The desired coating resistivity can be selected by predetermining the amount of metallic oxide or other modifier in the resistive frit and by controlling the thickness of the coating.

The afore-described method does not constitute part of this invention.

The resistivity of the material after it has been operated on according to this invention is believed to increase by roughly two times or more. The increase in resistivity is an indication of the vastly increased porosity and real surface area of a resistive element according to this invention, as compared with that of an element having an unmodified surface topography. As mentioned above, the resistivity of a material such as resistive frit, having its surface topography altered in accordance with this invention, shows a marked dependency of resistivity on the thickness of the coating, and to a lesser extent upon the nature of the substrate upon which the coating is applied.

Figure 13:
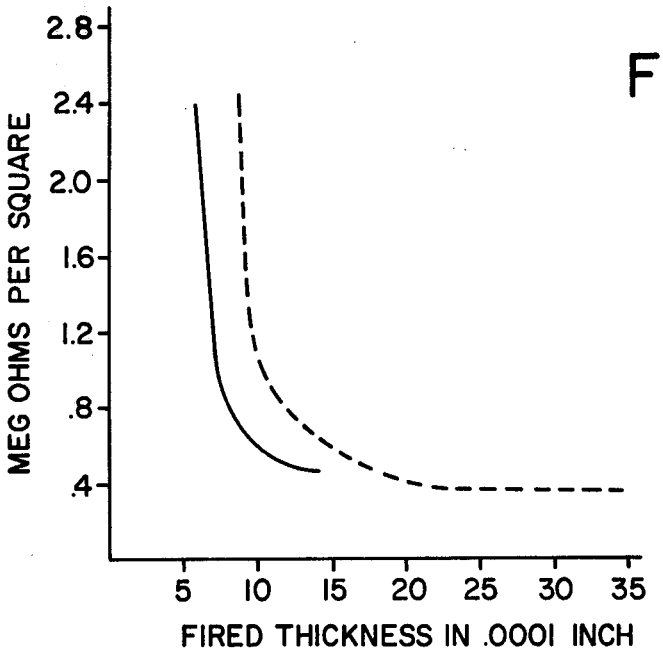
FIG. 13 is a graph of coating thickness vs. resistance characteristics of a coating embodying the present invention.

FIG. 13 is a graph showing the manner in which the resistance of a resistor made in accordance with this invention, as described above, varies with the thickness of the resistive coating and the substrate upon which it is applied. The broken line curve is a curve showing test results on a specimen in which a ceramic body was used as the substrate; the coating thickness varied between about 0.8 mils and 3.5 mils. It can be seen that the resistance increases very rapidly as the coating thickness is decreased below about 2.0 mils. The solid line curve shows test results for a specimen in which the substrate used to support the coating was a glass slide. The curve shows again that the resistance of the coating increases dramatically at the lower end of the coating thickness range. It should be noted that the thickness of the coating applied to the glass slide was somewhat less than that applied to the ceramic slide. In both cases the sharp break upward in resistance at the lower end of the coating thickness range is apparent and similar in its characteristic.

It can readily be seen from FIG. 13 that by merely varying the coating thickness, the same coating material can be used for both the arc suppression resistor 92 and the anti-static coating 94, even though the desired resistivity values of the two elements may be widely separated.

It has been found in the manufacture of the resistor 92 and anti-static coating 94, as described above, that the physical parameters of the coating (thickness, e.g.) and the manufacturing method parameters permit wide tolerance without degrading the efficacy of the end product resistive system.

Figure 14:
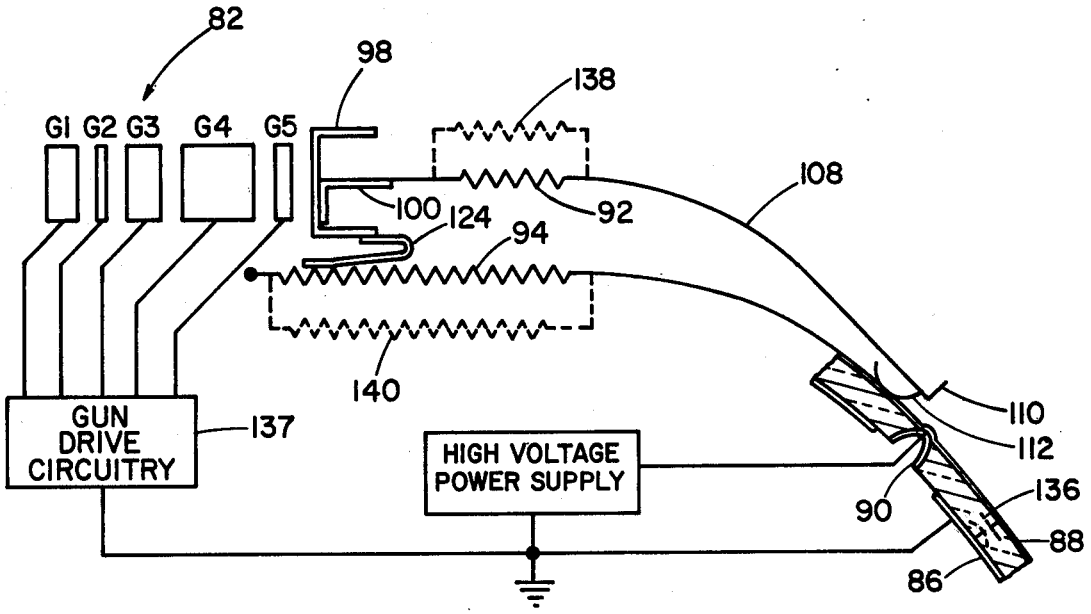
FIG. 14 is an electrical schematic representation of the tube components shown in FIG. 2.

A further discussion of the system of parallel resistors to accomplish arc suppression and static elimination will now be engaged, particularly with respect to FIG. 14. FIG. 14 is an electrical schematic diagram of the components of the FIG. 2 tube. The same reference numerals are used for electrical components in the FIG. 14 electrical diagram as are used for corresponding structural components in the FIG. 2 tube.

The high voltage smoothing filter constituted by the outer and inner conductive coatings 86 and 88 is shown symbolically in dotted lines at 136. It can be seen from FIG. 14 that the charged coatings 86 and 88 constitute a large storage capacitor 136 ready at all times during tube operation for an inducive condition to dump its charge to ground through any breakdown receptive pathway. It will be recognized that a protruding burr on one of the electrodes on the gun assembly 82 or a foreign particle in an inter-electrode space will create an arc inducive condition. Upon the occurrence of an arc, the high voltage filter capacitor 136 will dump through the parallel-connected arc suppression resistor 92 and the anti-static coating 94, through the anode electrode 98 and thence through the gun drive circuitry 137 to ground.

The relative values of the arc suppression resistor 92 and the anti-static coating 94 are important, at least in applications wherein the net impedance of the parallel pair of resistors 92 and 94 is at the low end of the range of acceptable values. In applications wherein the net impedance of the system is quite low, for example 1–100 kilohms, the level of arc current when arcing occurs would normally be in the range of a few amperes. At this level of arc current, it is desirable that the major part of the arc current pass through the arc suppression resistor 92 since the resistor is designed to withstand arc currents at much higher levels than that. This means that in applications wherein the net impedance of the parallel system is about 1–100 kilohms, the impedance of the arc suppression resistor should be much less than the impedance of the anti-static coating 94. By this expedient, the level of arc current that will pass through the anti-static coating 94 is low enough to avoid any possibility that the arc currents might chip neck glass, erode contact points or damage the coating 94.

The preferred net impedance range for the parallel resistive network comprising resistor 92 and coating 94 is in the order of 0.1–5 megohms. With a net impedance in that range, any arc currents that will result from an arc are relatively modest; it is not so important therefore that a major portion of the arc current be diverted away from the anti-static coating 94. In the preferred embodiments the arc suppression resistor 92 has, for example, an impedance value of 0.1–5 megohms; the anti-static coating has an impedance in the range of $10^7$–$10^9$ ohms.

It is desirable that the anti-static coating not have a DC resistance much greater than $10^9$ ohms, since at that level the RC time constant begins to exceed a desirable maximum value and the coating will begin to hold a charge too long. However, it is desirable that the anti-static coating 94 have a resistance value that will result in a high dynamic impedance of the parallel resistance system. If the anti-static coating 94 has a relatively low value, for example, in the low kilohm range or lower, it might cooperate with a yoke mounted on the tube to act to capacitively couple an arc transient around the discrete arc suppression resistor 92.

The resistance value of the parallel resistive network is preferably not greater than 30–50 megohms since above that range the IR drop resulting from leakage current flowing through the network will result in an unacceptable drop in the voltage on the anode electrode 98.

In FIG. 14 there is shown schematically in broken lines a resistor 138 shunting the arc suppression resistor 92. Resistor 138 is intended to symbolically represent an arc conduction path along the surface of the resistor which by-passes the body thereof. The conduction path is provided by the getterflash deposits 130 (FIG. 10). A similar surface conduction bypass path (140 in FIG. 14) may occur on the anti-static coating. Thus it is seen that the total resistive system for the arc suppression resistor and anti-static coating (neglecting stray capacitance) is really the four component sum of the parallel resistances 92, 94, 138 and 140. If arc currents can find a low resistance path in any of these four branches of the system, then the system has failed in its job to protect the gun and associated chassis circuitry.

A number of production prototype tubes having a parallel resistive network comprising an anti-static coating and discrete resistor as shown in FIG. 2 were constructed and very successfully tested. The getter in each tube was a standard gun-mounted, antenna-type gas-doped barium getter. The low voltage D.C. resistance of the resistive system was about 1 megohm. The tubes were given high voltage arcing tests and proved to hold up at 40 kV, 45 kV, 50 kV or even higher before significant arcing occurred. When the tubes did arc, which was less often than in non-arc-suppressed tubes of similar construction, arc currents associated with the discharge of the filter capacitor typically had a value of no more than a relatively harmless one ampere or less.

A breakdown voltage of 50 kilovolts and an arc current of 0.5 amperes implies a dynamic impedance of about 100,000 ohms. Typically, the measured dynamic impedance values for the prototype tubes tested were 5–20 times lower than the low voltage DC resistance of the resistive system. (Due to complex physical phenomena occurring during arcing, the dynamic impedance is considerably less than the DC resistance measured with an ohm meter. However these two values can be shown experimentally to correlate well.)

The difference between the measured low voltage DC resistance values and the dynamic impedance values is believed to be due in large part to the voltage sensitivity of the resistive elements.

The test results show the system according to this invention to be extremely effective in suppressing arcs to a level so low as to be incapable of causing damage to tube or chassis components or to impair the performance of either. The relative immunity of the FIG. 2 resistive system to the deposition of conductive material during getter flash has also been proved. Tests on prototype tubes as shown in FIG. 2 having resistive frit coatings 94, 120 -- a number made with and a number made without the use of camphor as a surface irregularizing agent -- showed a decrease in the low voltage DC resistance of the system by about 15–30%. We believe that the decrease in the dynamic impedance of this system due to flashing of the getter would be in the same order of magnitude. A drop of only 15–30% in the dynamic impedance of this system as a result of getter flash is not deemed to have a material effect on the performance of the system.

It could not be concluded from these tests, however, that the substantial immunity of the system to shorting by getter flash deposits was due to the irregularization of the surfaces of the resistive elements. We now believe that the unique geometry of the FIG. 2 system is largely responsible for the immunity of the system to getter flash shorting. In the FIG. 2 system the resistor 92 and coating 94: 1) are limited in area, 2) are disposed in the narrow neck of the tube hidden in part behind the flare of the neck from the source of the getter flash, and 3) have surfaces oriented substantially parallel to the direction of getter flash deposition. We believe that the surfaces of the resistive elements received so little getter material in these tests that the true merit of the surface irregularization according to this invention was not shown by those tests. Visual inspection readily confirmed the light getter flash deposition on the neck coating 94.

Other tests were conducted, however, on tubes having a different resistive coating geometry. These tests proved the worth of the surface irregularization of the present invention. These tubes had an internal funnel coating similar to the one shown in the prior art FIG. 1 tube and had the getter suspended from the shadow mask. In this arrangement a major part of the resistive coating is exposed to a getter flash, the deposition direction of which is not oblique, but rather frontal.

Two tubes were made up - a reference tube with a resistive frit coating without surface irregularization according to this invention, and a second improved tube having a coating with its surface irregularized following the teachings of this invention. Low voltage DC measurements were made before and after getter flash. In the improved tube having an irregularized coating surface, the initial low voltage DC resistance of the coating was 1.2 megohms. After getter flash the resistance of the coating dropped 17% to 1.0 megohms. In the reference tube the initial low voltage DC resistance of the coating was 980 kilohms. After getter flash the coating resistance dropped 80% to 200 kilohms. Thus it is concluded that where this invention is embodied in a tube having an arc suppressive resistive element which is exposed to a frontal getter flash, the resistive element suffers a loss in low voltage DC resistance (and thus it is believed in dynamic impedance) due to getter flash which is much less than a resistive frit coating having a standard (nonirregularized) surface.

Figure 1:
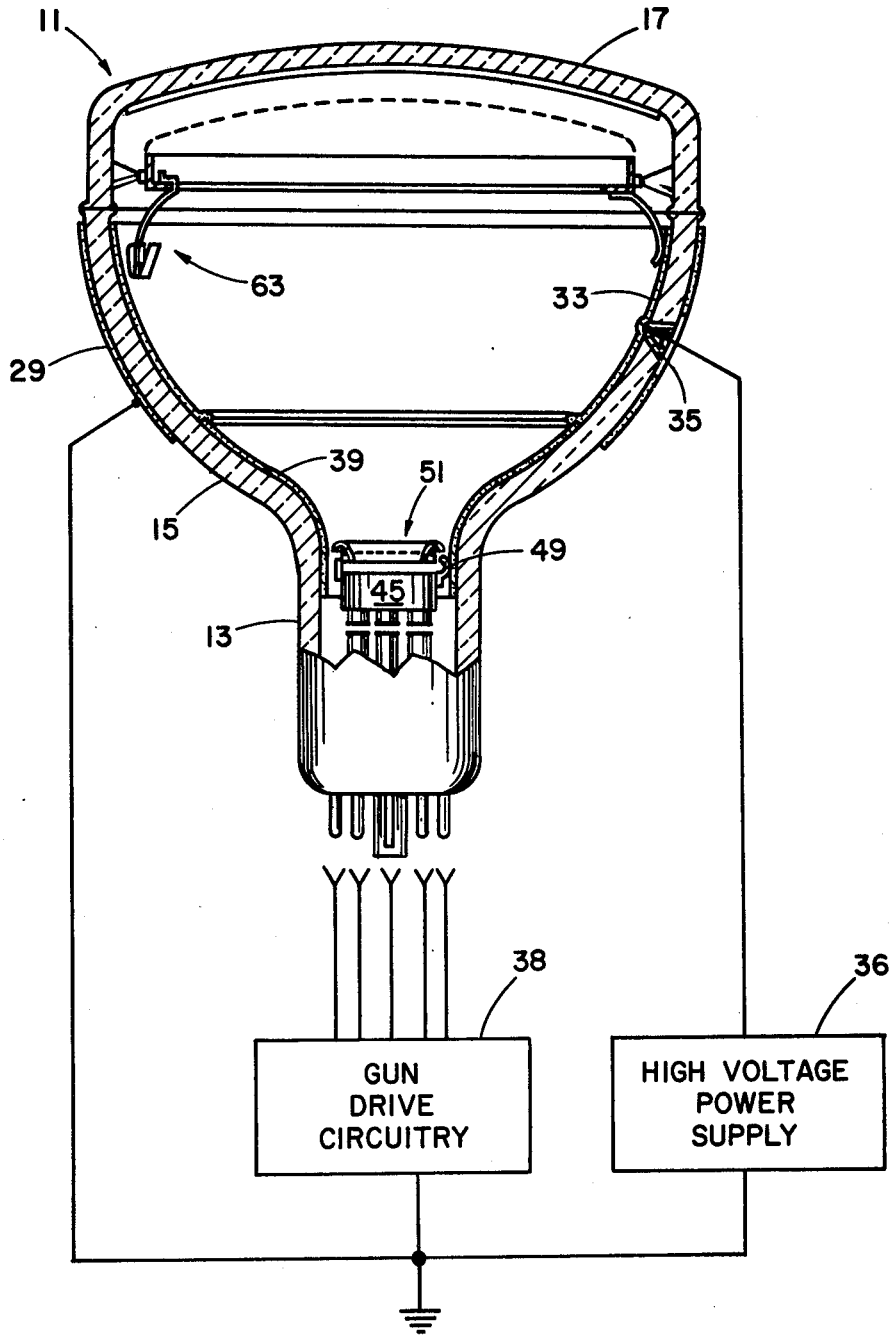
Fig. 1 PRIOR ART
FIG. 1 is a side sectional view of a prior art color cathode ray tube having an arc suppression system.

FIG. 14A will further assist in an understanding of conditions under which the present invention performs best. FIG. 14A is a graph plotted from data taken during experiments comparing the relative immunity of a resistive frit coating having an irregularized surface according to this invention versus a coating of the same material but having a non-irregularized surface. The test was conducted by evaporating aluminum onto glass slides containing resistive frit coatings (1 angstrom of aluminum has the equivalent conductivity of 5 angstroms of barium). Two slides having resistive frits of different composition but both irregularized according to the invention were compared in their immunity to shorting by aluminum deposition to two similar slides covered with coatings of the same material but having standard (non-irregularized) surfaces. Although the number of data points plotted is limited, some conclusions can be drawn. For light deposits of conductive material the resistive material having the standard (nonirregularized) surface resists conductive deposit shorting about as well as the same material having a surface irregularized according to this invention. However, as the amount of conductive material deposited is increased, the resistive frit material having the non-irregularized surface suffers a rapid drop in its DC resistance, whereas the material having a surface irregularized according to this invention suffers only a slight drop-off in the measured DC resistance. Relating these figures to the world of cathode ray tubes and arc suppression, it can be concluded that in arc suppressive resistor geometries wherein the amount of getter flash material which falls upon resistive element is extremely light, as appears to be the case in a system having the geometry shown in FIG. 2, then the fact of having the element surface irregularized or left unaltered, does not play a significant part in immunizing the system to getter flash shorting. However, in arc suppression resistor geometries such as shown in FIG. 1 wherein the area of the resistive element exposed to the getter flash is large and/or wherein it is exposed to a frontal getter flash, the merit of the invention is clear. In other words, in applications wherein the getter flash deposition is more severe either in its frontal directivity or in the amount of getter material deposited, resistor surface irregularization of the present invention clearly proves to be of great value.

Even with regard to a tube having a resistive system with the FIG. 2 geometry, the tests on which did not conclusively show the merit of the invention, applicants nevertheless believe that the use of resistive elements with irregularized surfaces provide added safety margin against getter flash shorting.

Whereas the material for the afore-described resistive element has been described as being a resistive frit, it is believed that other resistive materials may be employed. Agents other than camphor may be employed for irregularizing the surface topography of the resistive element -- for example, benzoic acid, ammonium carbonate or the like.

Figure 15:
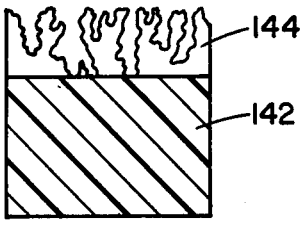
FIGS. 15–17 illustrate alternative embodiments of the present invention.
Figure 16:
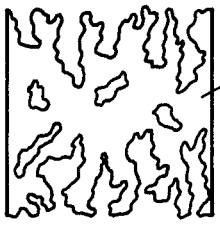
Figure 17:
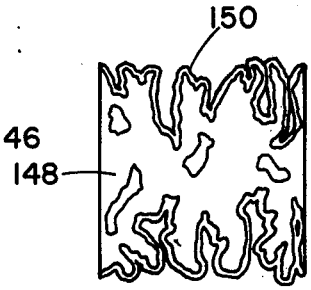

Whereas the above-described preferred embodiment of the discrete arc suppression resistor is illustrated as taking the form of a ceramic substrate upon which is deposited a high resistivity coating having the novel topographical configuration according to this invention, the objectives of the invention may be accomplished by other structures. For example as shown in FIG. 15, a substrate 142 could be employed which is not an insulator, but rather which has a preselected bulk resistivity. Substrate 142 supports a high resistivity coating 144. The net resistance of the FIG. 15 resistor would be the parallel combination of the resistive substrate 142 and the resistive coating 144. Yet another embodiment (FIG. 16) would involve a material which has a surface topography according to this invention; rather than being in the form of a coating on a substrate, however, it would take the form of a bulk resistor 146 in which the entire body may be heavily cavitated and porous. Yet another resistor embodiment (FIG. 17) would comprise an insulative body 148 with the topographical structure according to this invention, covered intimately and completely with a thin resistive coating 150 which could be smooth.

The dynamic impedance high voltage values referred to are as would be measured using test apparatus shown schematically in FIG. 18. Where reference numerals are employed in FIG. 18 which are common to reference numerals used earlier, they are intended to designate like elements. It is believed that FIG. 18 is self-explanatory. Dynamic impedance values are calculated by noting the peak current associated with the discharge of the filter capacitor 136, and dividing this number into the applied screen voltage at breakdown which appears across the filter capacitor 136.

Whereas the above description has been directed to standard television tubes, the resistive structures according to this invention could be employed in post deflection, wire-grid deflection-type, and other television tubes, and in non-television-related devices. It is contemplated that the merit of the present invention will be demonstrable for other than arc suppression. For example, in an internal voltage divider application, immunization to uneven getter flash deposits is important to prevent drastic alteration of the voltage ratios developed by the divider. The need for getter flash immunization is also critical in such other applications as scan magnification and post accelerations systems.

Other changes may be made in the above-described apparatus without departing from the true spirit and scope of the invention herein involved and it is intended that the subject matter in the above depiction shall be interpreted as illustrative and not in a limiting sense.

What is claimed is:

1. In a television cathode ray tube having a getter containing a vaporizable, electrically conductive, gas adsorptive getter material, the improvement comprising an electrically resistive element for arc suppression, internal voltage division, static elimination, RC signal coupling or the like, said resistive element being composed of a high resistivity material compatible with a clean, high-vacuum environment, said element being so widely and deeply cavitated and contorted at and below its nominal surface that the real surface of the element is shadowed and very greatly extended in area relative to the nominal surface of the element, having the effect that when the getter is flashed, the coating of conductive getter material deposited on the element is effectively dispersed and fragmented into isolated conductive islands, the result of which is to render tolerably insignificant the tendency of arc currents to travel over the surface of the element and thereby by-pass the body of the element.

2. For use in a television cathode ray tube having a getter containing a vaporizable, electrically conductive, gas adsorptive getter material, the improvement comprising an electrically resistive element for arc suppression, internal voltage division, static elimination, RC signal coupling, or the like, said resistive element being composed of a high resistivity material and having a leafy, coral-like plateau-less real surface having no continuous areas thereacross capable of being conductivized by normal getter material deposits to present an arc-encouraging surface by-pass path around the body of the element or to significantly lower the DC resistance of the element.

3. The apparatus defined by claim 2 wherein said resistive element is composed of a resistive frit and the said surface topography is substantially that associated with the crystallization of camphor or the like.

4. For use in a television cathode ray tube having a getter containing a vaporizable, electrically conductive, gas adsorptive getter material, the improvement comprising an electrically resistive element for arc suppression, internal voltage division, static elimination, RC signal coupling, or the like, said resistive element being so widely and deeply cavitated and contorted at and below the nominal surface of the element, and the real surface of the element being so shadowed and extended in area relative to the nominal surface that flashing of a getter in the tube does not materially reduce the impedance of the resistive element.

5. The apparatus defined by claim 4 wherein the bulk resistivity of the resistive element is at least twice the bulk resistivity of the raw material from which said element is composed.

6. The apparatus defined by claim 4 wherein said material is resistive frit and wherein the described surface topography of the resistive element is substantially that associated with the crystallization of camphor or the like.

7. In a television cathode ray tube comprising an evacuated envelope including a faceplate and a funnel having on an external surface an outer conductive coating and on an internal surface an inner conductive coating for receiving a high potential, said tube further comprising an electron gun located in a neck of the funnel for producing at least one beam of electrons, and getter means within said envelope containing a vaporizable, electrically conductive gas adsorptive getter material, the improvement comprising a getter-flash-tolerant arc suppression resistor supported by said gun and electrically connected in an electrical path between said inner conductive coating and a high voltage element of said gun, said arc-suppression resistor having a surface physically exposed to deposits of said getter material when said getter is flashed, said arc-suppression resistor comprising a ceramic or vitreous substrate on which is deposited a thin coating of a high resistivity material, said coating being so widely and deeply cavitated and contorted at and below the nominal surface thereof, and the real surface of the coating being so shadowed and extended in area relative to the nominal surface that normal getter deposits on the coating resulting from flashing of a getter in the tube are effectively dispersed and fragmented by the coating into isolated conductive islands such that the tendency of arc currents to travel over the surface of the coating and thereby to by-pass the element is tolerably insignificant.

8. The apparatus defined by claim 7 wherein said resistive coating is composed of a resistive frit and the said surface topography is substantially that associated with the crystallization of camphor or the like.

9. In a television cathode ray tube comprising an evacuated envelope including a glass faceplate and a funnel having on an internal surface an inner conductive coating for receiving a high-voltage charge, said tube further comprising an electron gun located in a neck of the funnel for producing at least one beam of electrons and a getter within said envelope containing a vaporizable, electrically conductive, gas-adsorptive getter material, the improvement comprising a getter-flash-tolerant anti-static coating around the beam egress from said gun on the inner surface of said neck, which coating is electrically connected to said inner conductive coating and has a surface physically exposed to a deposit of said getter material when said getter is flashed, said coating being composed of a high resistivity but non-insulative material and having a leafy, coral-like, plateau-less real surface having no continuous areas thereacross capable of being conductivized by normal getter material deposits to present an arc-encouraging surface by-pass path around the body of the element.

10. The apparatus defined by claim 9 wherein said resistive coating is composed of a resistive frit and the said surface topography is substantially that associated with the crystallization of camphor or the like.

11. In a television cathode ray tube including an evacuated glass envelope having on an external surface of a funnel portion thereof an outer conductive coating and on an internal surface thereof an inner conductive coating for receiving a high electrical potential, said tube further comprising an electron gun located in a neck of the funnel for producing at least one beam of electrons and having a getter containing a vaporizable, electrically conductive, gas adsorptive getter material, the tube further having an arc suppression and static elimination system comprising an arc suppression resistor and means for electrically and mechanically coupling said arc suppression resistor between said inner conductive coating and said electron gun, and an anti-static coating electrically and mechanically coupled to said inner conductive coating and surrounding the beam egress from said electron gun in order to collect and drain off beam-related stray electron charge, said arc suppression resistor and anti-static coating collectively constituting a parallel resistive network effective to suppress arcing in the tube, said anti-static coating acting as a static charge drain and as a high impedance by-pass prevention barrier around said arc suppression resistor, said system being characterized by each of said arc suppression resistor and anti-static coating being composed of a high resistivity material compatible with a clean, high vacuum environment, said element being so widely and deeply cavitated an contorted at and below its nominal surface that the real surface of the element is shadowed and very greatly extended in area relative to the nominal surface of the element, having the effect that when the getter is flashed, the coating of conductive getter material deposited on the element is effectively dispersed and fragmented into isolated conductive islands, the effect of which is to render tolerably insignificant the tendency of arc currents to travel over the surface of the element and to thereby by-pass the body of the element.

12. The apparatus defined by claim 11 wherein said arc suppression resistor is a discrete resistor comprising a substrate on which is disposed a coating of resistive frit material having a DC resistance in the range of 0.1–5 megohms, and wherein said anti-static coating is composed of resistive frit material having a DC resistance in same range or higher.

13. In a television cathode ray tube including an evacuated glass envelope having on an external surface of a funnel portion thereof an outer conductive coating and on an internal surface thereof an inner conductive coating for receiving a high electrical potential, said tube further comprising an electron gun located in a neck of the funnel for producing at least one beam of electrons and a getter assembly comprising a pan containing a vaporizable, gas-adsorptive material and a leaf spring support for the pan, the tube having an arc suppression and static elimination system comprising an arc suppression resistor including means mechanically anchored to the forward end of said gun and supporting said getter assembly in contact with said inner conductive coating, said arc suppression resistor including a resistive arc suppression coating electrically coupled in series with said gun and with said getter assembly and thus with said inner conductive coating, said apparatus including an anti-static coating deposited on the inner surface of said neck and having a DC resistance value greater than the DC resistance value of said arc suppression resistor, said anti-static coating being electrically and mechanically coupled to said inner conductive coating and surrounding the beam egress from said electron gun in order to collect and drain off beam-related stray electron charge, said arc suppression resistor and anti-static coating collectively constituting a parallel resistive network effective to suppress arcing in the tube, said anti-static coating acting as a static charge drain and as a high impedance by-pass prevention barrier around said arc suppression resistor, said system being characterized by each of said arc suppression and anti-static coatings being so widely and deeply cavitated and contorted at and below its nominal surface, and the real surface thereof being so shadowed and extended in area relative to the nominal surface thereof that normal flashing of the getter in the tube does not reduce the DC resistance of the parallel resistive network by more than one-third.

14. The apparatus defined by claim 13 wherein the material of each of said coatings is resistive frit and wherein the described surface topography of the coatings is substantially that associated with the crystallization of camphor or the like.

* * * * *